US006607361B1

(12) United States Patent
Kotter et al.

(10) Patent No.: US 6,607,361 B1
(45) Date of Patent: Aug. 19, 2003

(54) PUMPING METHOD AND DEVICE

(75) Inventors: Robert Kotter, Bruck (DE); Markus Ficht, Steinhöring (DE)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/787,989

(22) PCT Filed: Sep. 22, 1999

(86) PCT No.: PCT/EP99/07063

§ 371 (c)(1),
(2), (4) Date: Jul. 17, 2001

(87) PCT Pub. No.: WO00/19086

PCT Pub. Date: Apr. 6, 2000

(30) Foreign Application Priority Data

Sep. 25, 1998 (DE) ..... 198 44 163

(51) Int. Cl.[7] ..... F04B 17/00
(52) U.S. Cl. ..... 417/53; 417/383
(58) Field of Search ..... 417/53, 413.1, 417/412, 417, 383, 385, 386, 387, 388

(56) References Cited

U.S. PATENT DOCUMENTS 3,461,808 A * 8/1969 Nelson et al. ..... 103/150
4,086,036 A * 4/1978 Hagen et al. ..... 417/413
4,278,406 A * 7/1981 Cooperrider ..... 417/109
4,309,153 A * 1/1982 Panick et al. ..... 417/252
4,643,653 A * 2/1987 Masaka et al. ..... 417/417
5,249,932 A * 10/1993 Van Bork ..... 417/386
5,492,449 A * 2/1996 Hunklinger et al. ..... 417/259
5,639,062 A * 6/1997 Irgens et al. ..... 251/120

* cited by examiner

*Primary Examiner*—Charles G. Freay
*Assistant Examiner*—Han L. Liu
(74) *Attorney, Agent, or Firm*—Ziolkowski Patent Solutions Group, LLC

(57) ABSTRACT

The invention relates to a method for the metered, pulsed pumping of fluid media under high pressure, in which a pressure surge resulting from the stored, kinetic energy of an electromagnetically driven armature element of a reciprocating pump is transmitted via a blocking element to a working fluid, which is enclosed in a pressure space connected to a spraying device, resulting in a predetermined quantity of the working fluid being conveyed out of an spraying unit, the stored, kinetic energy of the armature element being abruptly transmitted first of all to an operating fluid, which is enclosed in a pressure-accumulating space arranged upstream of the pressure space, inducing a pressure surge which is transmitted in the operating fluid in an expanding manner to the blocking element and from the blocking element to the working fluid.

64 Claims, 4 Drawing Sheets

PUMPING METHOD AND DEVICE

The invention relates to a pumping method and a pump arrangement for the metered pumping of small quantities of liquid under high pressure.

Pumping methods and pump arrangements of this type are disclosed, for example, in WO 93/18296, EP-A-629265 and WO 96/34196. The stored, kinetic energy of the armature device of these pump arrangements which operate in a pulsating manner act directly via the armature, or indirectly via tappet or valve-seat devices, on the fluid medium to be pumped, these devices being surrounded by the fluid medium. In both cases, the kinetic energy is conveyed by solid bodies abruptly and directly onto the liquid to be pumped, which in quite a few applications may lead to an unfavorable expansion of the pressure wave in the liquid to be metered, with the consequence that the metering cannot be carried out with sufficient precision.

It is disclosed in DD patent specification 213 472 to seal off the armature-space device from the delivery space by means of an elastic, movable diaphragm, the diaphragm being reached through by the tappet, which is acted upon by the armature.

DD patent specification 1574 28 describes a pump arrangement of the generic type for the metered spraying of fuel and/or lubricant or alcohol or water, in which the electromagnetic drive is separated from the liquid-conducting space by means of a blocking element in the form of a diaphragm. The armature or pulse-generating element of the electromagnetic drive strikes against the diaphragm and transmits its stored, kinetic energy to the liquid to be sprayed which is located in the liquid-conducting space.

In the two pump arrangements which are described above and have a diaphragm, although the diaphragm ensures that spaces within the pump arrangement are sealed off, it causes considerable, inadvertent losses of kinetic energy, for example as a consequence of friction between the tappet and diaphragm and/or deformation of the diaphragm, during the transfer of the kinetic energy of the armature or tappet to the liquid.

The object of the invention is to provide a pumping method and a pump arrangement which operate in accordance with the energy-storage principle and with which the metering can be optimized without an inadvertent loss of the stored, kinetic energy occurring. A further object is to keep the electromagnetic drive means and the armature and/or tappet free of the liquid to be metered without an inadvertent energy loss occurring during the energy transfer.

This object is achieved by the features of claims 1 and 22. Advantageous developments of the invention are defined in the subclaims dependent on these claims.

According to the invention, a pressure-surge utilizing space (called pressure space below), which contains the liquid to be metered, is separated by a diaphragm from a pressure-surge generating and accumulating space (called pressure-accumulating space below), which contains a pressure-surge transmitting liquid, the stored, kinetic energy being abruptly transmitted first of all to the pressure-surge transmitting liquid in the pressure-accumulating space and a pressure-surge wave being generated which expands in this liquid and is transmitted by this liquid to the diaphragm and by the diaphragm to the liquid in the pressure space.

The speed of expansion and the energy of the surge wave in the pressure-surge transmitting liquid located in the pressure-accumulating space is dependent on the specific properties of said liquid, and so by appropriately selecting this liquid the energy transfer can be influenced in a specific manner. In addition, the selection of the material and the dimensions of the diaphragm enables the energy transfer to the liquid to be metered in the pressure space to be influenced in a specific and more far-reaching manner by, for example, an elastically extensible, compressible and shock-absorbing diaphragm being used or by an incompressible diaphragm which does not reduce the energy or reduces the energy because of its material properties being used.

In each case, the diaphragm separates the pressure-accumulating space from the pressure space in such a manner that the liquid in the pressure space does not come into contact with the electromagnetic drive means, with the result that even corrosive or aggressive liquids can be metered using the method according to the invention and the pump arrangement according to the invention, a liquid which does not act corrosively or aggressively on the drive means with which it comes into contact being used as the pressure-surge transmitting liquid. Provision merely has to be made here for the small number of parts in the pressure space which come into contact with the corrosive or aggressive liquid to be metered to consist in terms of material of an appropriately resistant material.

It is essential for the pressure space, which is partitioned off from the pressure-accumulating space by the diaphragm, to be connected to a feeding device for the liquid to be metered. It is also expedient if the pressure-accumulating space and/or the flood space, which is still located upstream of the pressure-accumulating space, is filled with a liquid and is connected to an equalizing container containing, for example, the same liquid, with the result that during a pumping and return stroke liquid can be sucked out of the equalizing container or pushed into the equalizing container. It is, moreover, expedient to continuously or intermittently recirculate the liquid in the pressure-accumulating space and/or in the flood space, so that relatively cool liquid is circulated, as a result of which the liquid which is to be sprayed and is in the pressure space is also cooled, if appropriate, and cavitation can thus be avoided at least to the greatest possible extent.

The invention is explained in greater detail below using examples and referring to the drawing, in which.

Figure 1:
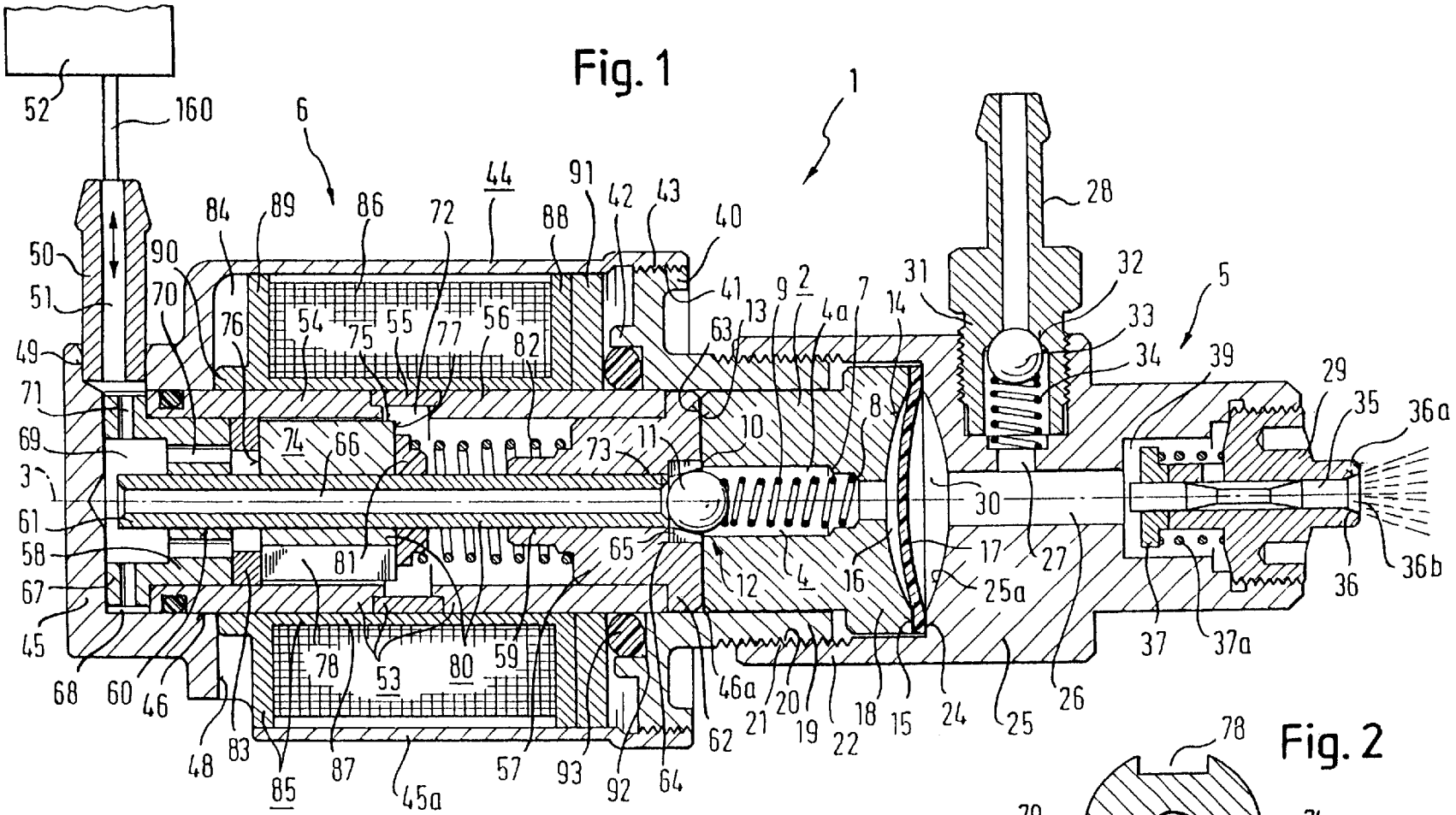
FIG. 1 shows, schematically in longitudinal section, a first exemplary embodiment of a pump arrangement according to the invention.

A pump arrangement 1 according to the invention (FIG. 1) has a pressure-accumulating-space cylinder 2 which has a stepped through hole 4 around its central axis 3.

An ejecting device 5 is arranged upstream of the pressure-accumulating-space cylinder 2 in an axial manner on the delivery side and an electromagnetic drive unit 6 is arranged downstream on the drive side. The through hole 4, which essentially forms a pressure-accumulating space 4*a*, is constricted twice in the end region on the ejecting or delivery side, forming a first annular step 7 and a second annular step 8. A compression spring 9 is seated on the annular step 8, which compression spring extend into the drive-side region of the through hole 4 and at this point stresses a ball 11 which fills the drive-side opening 10 of the through hole 4 and belongs to a ball-valve device 12 which is still to be described.

The drive-side end surface 13 of the pressure-accumulating-space cylinder 2 is planar. The ejecting-side end surface 14 of the pressure-accumulating-space cylinder 2 is depressed in the direction of the drive side, for example is designed such that it is recessed in a concavely curved manner in cross section and has an annular bearing surface 15 on the periphery. The cavity 16 formed by the recess is covered by a blocking element which is designed as a diaphragm 17 and bears against the bearing surface 15.

On the diaphragm side, the pressure-accumulating-space cylinder 2 expediently has an annular web 18 which, on the delivery side, forms the annular bearing surface 15 for the diaphragm 17.

The pressure-accumulating-space cylinder 2 is fitted, butting against a stop element, by its drive-side region in a form-fitting manner into a connecting cylinder 19 having an external thread 20, said connecting cylinder being overlapped in a screwed manner from the ejecting side or delivery side by a cylinder region 22 of the ejecting device 5, which region has a corresponding internal thread 21, wherein in the cylinder region 22 an annular step 24 lying opposite the bearing surface 15 is provided and the diaphragm 17 is clamped in place by the bearing surface 15 and the annular step 24. The above arrangement results in the pressure-accumulating space 4*a* between the ball 11 of the ball-valve device 12 and the diaphragm 17, which pressure-accumulating space essentially comprises the through hole 4 and the cavity 16 which is formed by the recess.

The ejecting device 5 has a delivery housing 25 on which the cylinder region 22 is formed on the drive side; an axial pressure-chamber hole 26, which lies in the axis 3 and widens in a number of steps in the ejecting-side region, is introduced in the delivery housing 25 from the cylinder region 22. Adjacent to the region 22, an admission hole 27 which opens into the pressure-chamber hole 26 is placed radially with respect to said pressure-chamber hole, said admission hole being designed such that it widens in two steps toward the outside of the delivery housing and in the outer region accommodates a nipple-shaped feeding device 28. A working-fluid spraying device 29 is placed into the last step of the pressure-chamber hole 26 on the ejecting side. The drive-side end surface 25*a* of the delivery housing 25 has the annular step 24 on the periphery and starting in the region of the annular step 24 is depressed in the direction of the delivery side as far as the pressure-chamber hole 26, for example is designed such that it is recessed in a concavely curved manner: in cross section. The cavity 30 formed by the recess is covered on the drive side by the diaphragm 17.

The feeding device 28 is designed as a one-way valve (which is essentially known) comprising a connecting branch 31 having a conical valve seat 32 against which a spherical valve body 33 is pressed by a compression spring 34 which is supported against an annular step of the admission hole 27 in the delivery housing 25. The one-way, valve therefore enables the admission of the fluid to be ejected (called working fluid below) to the pressure-chamber hole 26 and blocks the flow direction of the working fluid to the outside.

The working-fluid spraying device 29 preferably essentially has a nozzle needle 35 and jet-shaping zone 36 (found in the free end region of the nozzle body) and a threshold-pressure valve which is formed by a conical valve seat 36*a* in the nozzle body and a corresponding, truncated region 36*b* of the nozzle needle 35, the truncated region 36*b* and the valve seat 36*a* being brought under prestress into a bearing arrangement via a valve disk 37 and a compression spring 37*a*.

The above arrangement results in the cavity 30 together with the pressure-chamber hole 26 forming a pressure space 39 which is partitioned off on the drive side by the diaphragm 17, on the ejecting side by the spraying device 29 and by the one-way valve in the feeding device.

On the drive-end side, the connecting cylinder 19 has an annular web 40 which extends radially outward and is L-shaped in cross section. An external thread 41 is provided on the outer casing surface of the annular web 40. An annular web 42 which extends toward the drive side is arranged on the drive-side end surface of the annular web 40.

A pump housing 44 is arranged on the drive side of the annular web 40, said pump housing serving to accommodate all essential parts of the drive unit 6 which is essentially known and operates according to the solid-state energy-storage principle.

The pump housing 44 is an essentially cup-shaped body with a cup bottom 45 and a cylindrical casing 45*a*. The central cylinder axis of the pump housing 44 is aligned with the axis 3 of the pump-accumulating-space cylinder 2. The internal contour of the pump housing 44 has a stepped constriction in the cup-bottom region, resulting in the formation of a recess 46 which is in the form of a blind hole and merges by way of an annular step 48 into the cylinder casing 45*a*.

The delivery-side opening of the pump housing 44 is provided with an internal thread 43 which is seated on the external thread 41 of the annular web 40.

Provided in the region of the cup bottom 45 is a radially extending hole 49 which penetrates the pump housing 44 and in which a connecting branch 50 engages whose central hole 51 provides a possibility for connecting the interior of the drive unit 6 to an equalizing container 52 arranged outside the pump housing 44.

The recess 46 of the pump housing 44 in the region of the cup bottom 45 and the cylindrical interior 46*a* of the connecting cylinder 19 are arranged in an axially aligned manner and have the same diameter. An armature cylinder 53 is held in a form-fitting manner in the recess 46 and in the interior 46*a*, said armature cylinder extending from the cup-bottom region into the connecting cylinder 19.

The armature cylinder 53 is of multipart design and has, axially one behind another, a cylindrical armature sleeve 54 on the cup-bottom side, an annular element 55 and a delivery-side, cylindrical armature sleeve 56, the armature sleeves 54, 56 being arranged spaced apart by means of the annular element 55 arranged between them.

A first guide cylinder 57 is fitted in a form-fitting manner into the armature sleeve 56 on the delivery side. A second guide cylinder 58 is fitted in a form-fitting manner into the armature sleeve 54 on the cup-bottom side. The two guide cylinders have a respective axial through hole 59, 60 which are aligned axially with each other. The armature cylinder 53 and the guide cylinders 57, 58 therefore bound an essentially cylindrical cavity which is referred to below as the armature space 72.

The delivery-side guide cylinder 57 has, on the outer circumference on the delivery side, an annular web 62 which bears against the armature cylinder 53 as an axial stop. The delivery-side end surface 63 of the guide cylinder 57 comes to bear against the end surface 13 of the pressure-accumulating-space cylinder 2 forming an abutment. The through hole 59 ends on the delivery side with an axial, cylindrical ring-shaped recess 64 on whose annular bottom are arranged, distributed around the circumference, a plurality of ribs 65 which, in longitudinal section, are approximately — as seen from the delivery side — run-on ramp-shaped and whose ejecting-side end surfaces each form stop surfaces for the spring-stressed ball 11. When the ball 11 is pressed on, the gaps remaining between the ribs 65 form a hydraulic connection between the through hole 4 of the pressure-accumulating-space cylinder 2 and a drive-side flood space, as is explained further on.

Integrally formed on the cup-bottom side of the guide cylinder 58 on the cup-bottom side is an annular web 67 whose outside diameter is somewhat smaller than the inside diameter of the recess 46, with the result that an annular gap 68 is formed between the pump housing 44 and guide cylinder 58. In that region of the guide cylinder 58 which is on the cup-bottom side its through hole 60 widens radially in the manner of a blind hole, resulting in the formation of a bottom chamber 69. From the bottom chamber 69 overflow holes 70 extend parallel to the axis of the central axis 3 and penetrating the guide cylinder 58 into the annular space 72, and in the annular web 67 radial overflow holes 71 extend into the annular gap 68.

A hollow-cylindrical, elongated armature-bearing tube 61 whose cylindrical cavity forms a through space 66 for a fluid is mounted in a form-fitting and axially slidable manner in the through holes 59, 60.

The armature-bearing tube 61 protrudes into the bottom chamber 69 and extends in the axial direction from the bottom chamber 69 until shortly before the opening of the through hole 59 into the recess 64. The delivery-side end of the armature-bearing tube 61 is chamfered in the shape of a hollow cone toward the through space 66, this chamfer 73 being arranged at an axial distance $s_v$ away from the ball 11 in a starting position of the pump arrangement 1 which has yet to be described.

The chamfer 73 of the armature-bearing tube 61 forms the valve seat for the ball 11 of the ball-valve device 12, the ball-valve device 12 being open in the starting position of the pump arrangement 1.

In that part of the armature space 72 which is on the cup-bottom side, a cylindrical armature 74, arranged upstream of the guide cylinder 58, is seated on the armature-bearing tube 61, said armature having a casing surface 75, an end surface 76 on the cup-bottom side and a delivery-side end surface 77 and its axial longitudinal extent corresponding approximately to half the axial length of the armature space 72.

Figure 2:
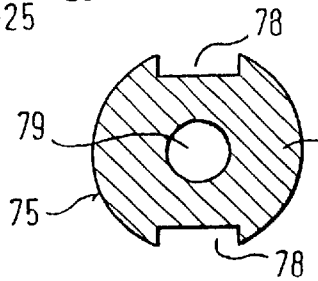
FIG. 2 shows, in cross section, an armature of the pump arrangement shown in FIG. 1.

A small amount of play is provided between the casing surface 75 of the armature 74 and the inner surface of the armature sleeves 56, 57, so that, if the armature 74 and the armature-bearing tube 61, which is connected fixedly to the armature 74, move to and fro, the armature 74 does not touch the inner surfaces of the armature sleeves 56, 57. The armature 74 has, for example, essentially a circular cross-sectional form (FIG. 2) with, in the region of the casing surface 75, at least one relatively wide and flat groove 78 which is continuous in the direction of the longitudinal axis. A continuous hole 79, through which the armature-bearing tube 61 reaches, is placed centrally in the armature 74 in the direction of the longitudinal axis.

The armature-bearing tube 61 is connected to the armature 74 with a force fit. The unit comprising t he armature-bearing tube 61 and armature 74 is referred to in the following as the armature element 80. The armature element 80 may also be of one-piece or integral design.

A stepped ring 81 having an annular step is arranged upstream of the armature 74 axially on the delivery side. A compression spring 82, which presses the armature element 80 in the direction of the guide cylinder 58, is seated between the stepped ring 81 and the guide cylinder 57, which is spaced apart therefrom, the end surface 76 of the armature 74 coming to bear against an annular element 83 which is arranged upstream of the guide cylinder 58 axially on the delivery side.

The outer surface of the armature cylinder 53 and the cylinder casing 45*a* of the pump housing 44 form an annular space 84 which is essentially in the shape of an annular cylinder in cross section and is bounded on the cup-bottom side by the annular step 48. Located in this annular space 84 is a coil module 85, which is fitted in a form-fitting manner on the armature cylinder 53, said coil module comprising at least one coil 86 a and a coil-support cylinder 87 having two flange rings 88, 89 which are spaced apart and extend radially outward as far as the casing 45*a* of the pump housing 44. In the axial direction on the cup-bottom side, the coil-support cylinder 87 has an annular web 90 which extends in an axially parallel manner and bears against the annular step 48. On the delivery side, a disk-shaped annular element 91 is arranged upstream of the flange web 88 of the coil-support cylinder 87.

That part of the end surface of the connecting cylinder 19 which is on the drive side and lies radially within the annular web 42 and that part of the delivery-side end surface of the annular element 91 which lies opposite form together with the inner surface of the annular web 42 and that part of the outer surface of the armature sleeve 56 which lies opposite it an annular chamber 92 into which a sealing ring 93, in particular an O-ring, is fitted.

The pump arrangement 1 according to the second exemplary embodiment (FIG. 3) has essentially the same structure as the above-described pump arrangement 1, and so parts having the same spatial shape and the same function are identified with the same reference numbers.

In contrast to the first exemplary embodiment, the pump arrangement 1 according to the second exemplary embodiment has devices which enable operating fluid to flow continuously through the armature space 72 and to intermittently flush the pressure-accumulating space 4*a*.

For this purpose, the pressure-accumulating-space cylinder 2, the connecting cylinder 19 and its L-shaped annular web 40 together with the thread 41 and the annular web 42 of the first exemplary embodiment are combined integrally to form an essentially cylindrical valve support 94 in which a fluid-feeding device 95 together with a nonreturn valve 96 is seated radially in its outer casing region.

The valve support 94 has a central through hole 97 which is first of all constricted once on the ejecting side and on whose annular step 98 the compression spring 9 is supported. On the ejecting side, the through hole 97 widens radially twice, resulting in the formation of an annular step 99 and an annular step 100 which is arranged upstream of the annular step 99 on the ejecting side, said steps being at a small axial distance from each other. The diaphragm 17 bears against the annular step 100, producing between the annular step 99 and the diaphragm a cavity 101 into which the through hole 4 opens and which is sealed on the ejecting side in a fluid-proof manner by the diaphragm 17. In the radially outer region of the cavity 101 a flood hole 102 is placed into the valve support 94, said flood hole running parallel to the longitudinal axis, being angled radially outward at the drive end and hydraulically connecting the cavity 101 to the nonreturn valve 96. On the ejecting side, an axial annular web 100*a* is integrally formed in the outer region of the annular step 100, said axial annular web serving to hold parts of the ejecting device 5. The external thread 20 is fixed on the pump side of the casing surface of the valve support 94.

On the drive-end side, the guide cylinder 57 bears with its ejecting-side end surface 63 against an annular end-surface subregion 103 of the valve support 94. An annular groove 104 is introduced axially in the end-surface subregion 103 in a radially encircling manner, which groove together with the end surface 63 of the guide cylinder 57 forms an annular chamber 105.

In its region inserted in the valve support 94, the feeding device 95 has a nonreturn valve 96, a fluid-branching-off device having an annular chamber 107 being formed in the region radially outside the nonreturn valve 96. The annular chamber 107 is connected to the armature space 72 via a transverse-flow hole 106, the annular chamber 105 in the end surface 103 of the valve support 94 and one or more axially parallel flush holes 108 in the guide cylinder 57. The feeding device 95, the annular chamber 107, the transverse-flow hole 106, the annular chamber 105, the flush holes 108, the armature space 72, the overflow holes 70, the bottom chamber 69, the overflow hole 71, the annular gap 68 and the connecting branch 50 therefore form a flow path I for a fluid through which the fluid can flow continuously. The continuous flow through the flow path I is used primarily for lubricating the moving drive parts and conducting away heat from the drive unit 5 of the pump arrangement 1.

The feeding device 95, the nonreturn valve 96, the flood hole 102, the pressure-accumulating space 4*a*, the gaps between the ribs 65, the through space 66, the bottom chamber 69, the overflow holes 71, the annular gap 68 and the connecting branch 50 form a flow path II which is open as long as the ball 11 is at a distance from the chamfer 73. During operation the flow path II enables intermittent flow through the pressure-accumulating space 4*a*, which effectively prevents cavitation phenomena in the pressure-accumulating space 4*a*.

The ejecting device 5 essentially comprises an annular diaphragm holder 112 and a cylindrical pump housing 25 into which is inserted, on the drive side, a static-pressure valve 122 and, on the ejecting side, the working-fluid spraying device 29 and, radially in the outer region, a working-fluid admission device 24. A union nut 120, which is screwed to the external thread 20, is used in order to fasten the ejecting device 5 to the valve support 94.

The annular diaphragm holder 112 is arranged upstream of the diaphragm 17 in an axial manner on the ejecting side and has a drive-side end surface 113 which fixes the diaphragm 17 in a clamping manner against the annular step 100. The diaphragm holder 112 radially bounds a cylindrical interior space 114 which is sealed on the drive side by the diaphragm 17.

In an axial manner on the ejecting side the diaphragm holder 112 is followed by the cylindrical pump housing 25 which has, on the drive side of its casing surface, an annular web 115 whose drive-side end surface 117 bears against the diaphragm holder 112. The pump housing 25 has a central pressure-chamber hole 26 which runs in the direction of the longitudinal axis, is constricted in one step first of all from the drive side forming the annular step 118 and is widened a number of times toward the ejecting side. The pressure-chamber hole 26 and the cavity 114 together form the pressure space 39 of the ejecting device 5. Located on the drive-side end surface of the pump housing 25 in the cavity 114 is the spring-stressed static-pressure valve 122 which is arranged upstream of the pressure-chamber hole 26 and maintains, in the region of the pressure-chamber hole 26, a higher level of pressure than in the cavity 114.

Radially between the static-pressure valve 122 and the diaphragm holder 112 an admission hole 123 is made in the pump housing 25 parallel to the longitudinal axis and connects the cavity 114 hydraulically to the working-fluid admission device 124 which is seated radially in he pump housing 25 and has a nonreturn valve.

On the ejecting side, the working-fluid spraying device 29 is arranged in the through hole 26 which is widened a number of times.

The above arrangement results in the working-fluid admission device 124, the admission hole 123, the interior space 114, which is sealed on the drive side by the diaphragm, the static-pressure valve 122, the through hole 26 and the spraying device 29 forming a flow path III for a working fluid.

The diaphragm holder 112 and the pump housing 25 are fixed axially via the union nut 120 which engages around the annular web 115 and is screwed to the external thread 20. This screw connection also ensures that the diaphragm 17 is clamped in place and, as a result, that the pressure-accumulating space 4*a* is separated in a hydraulically tight manner from the pressure space 39.

Figure 4:
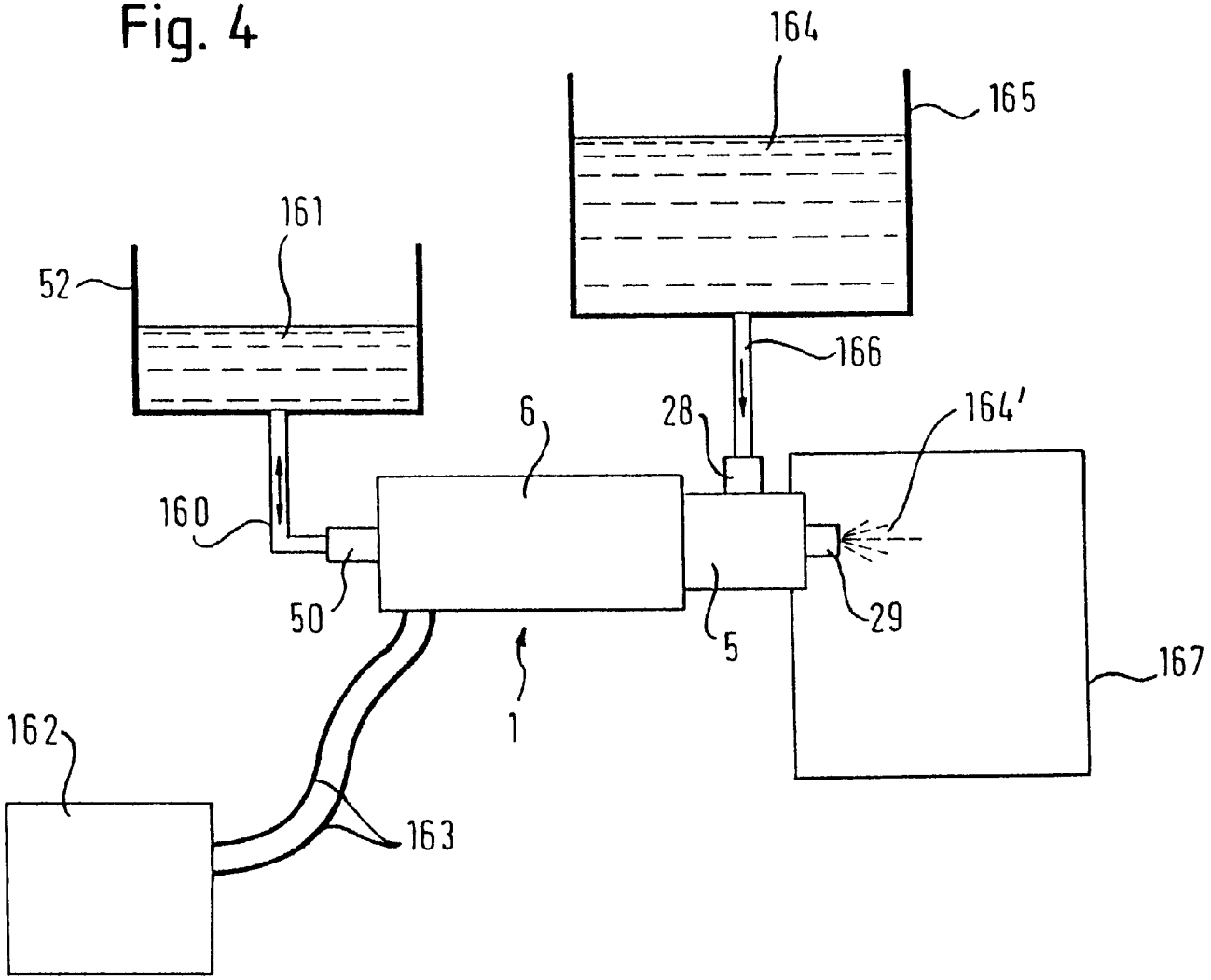
FIG. 4 shows, schematically, the arrangement of a pump arrangement according to FIG. 1 in one case of application.

In FIG. 4 one case of application of a pump arrangement according to FIG. 1 is illustrated schematically. The pump arrangement 1 is connected via an equalizing line 160, which is fitted to the connecting branch 50, to the equalizing container 52 which is filled with an operating fluid 161. The power supply of the pump arrangement 1, in particular the drive unit 6, is ensured via electrical supply lines 163 by a control device 162. The working fluid 164 which is to be pumped is located in a supply tank 165 which is connected to the feeding device 28 via a feed line 166. Atomized operating fluid 164 which is under pressure leaves the pump arrangement 1 via the working-fluid spraying device 29 and is provided to a user 167, in particular to a fuel cell. If the need arises, a hydraulic connecting line may also be provided between the ejecting device 5 and the user 167.

Figure 3:
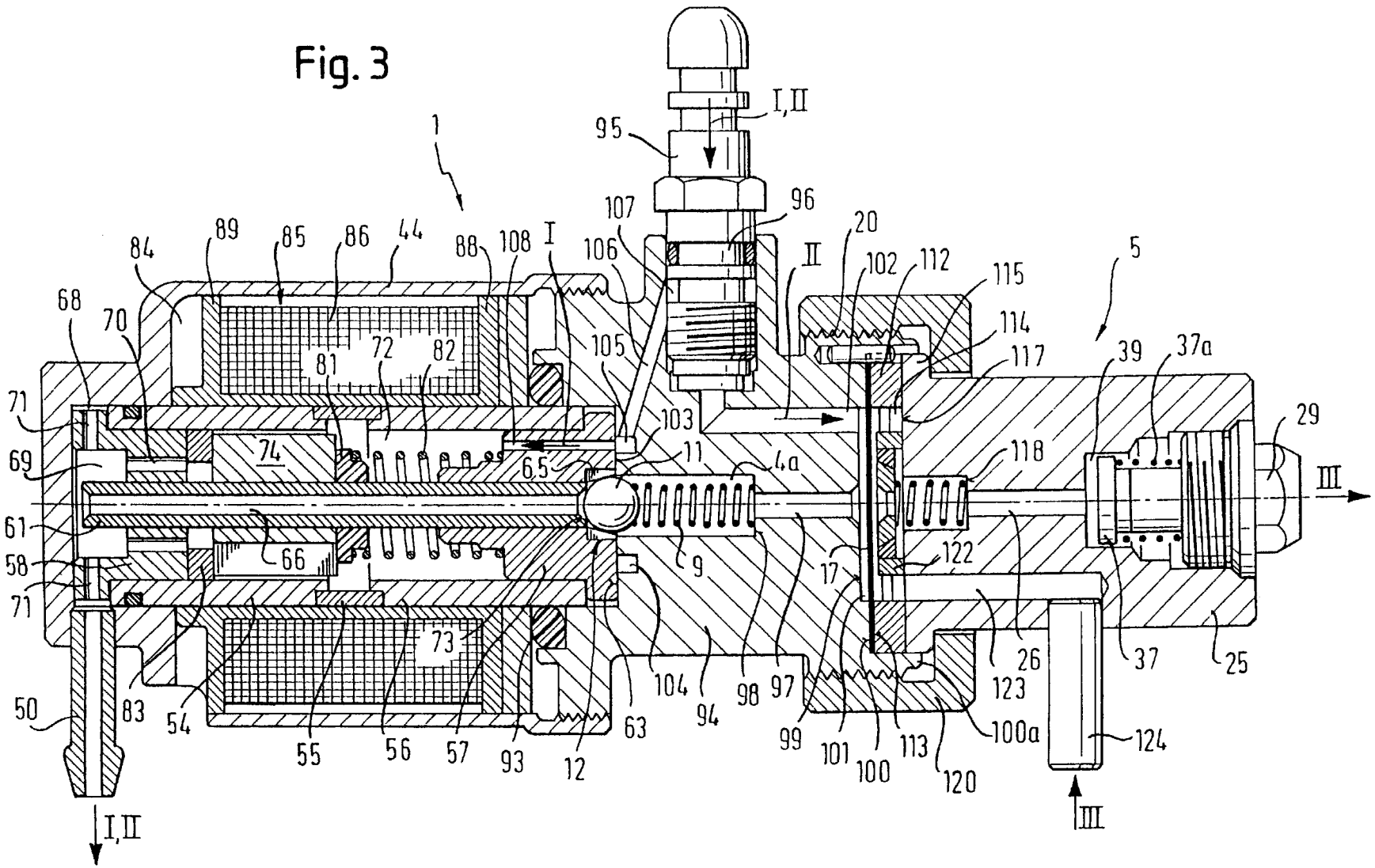
FIG. 3 shows, schematically in longitudinal section, a second exemplary embodiment of a pump arrangement according to the invention.
Figure 5:
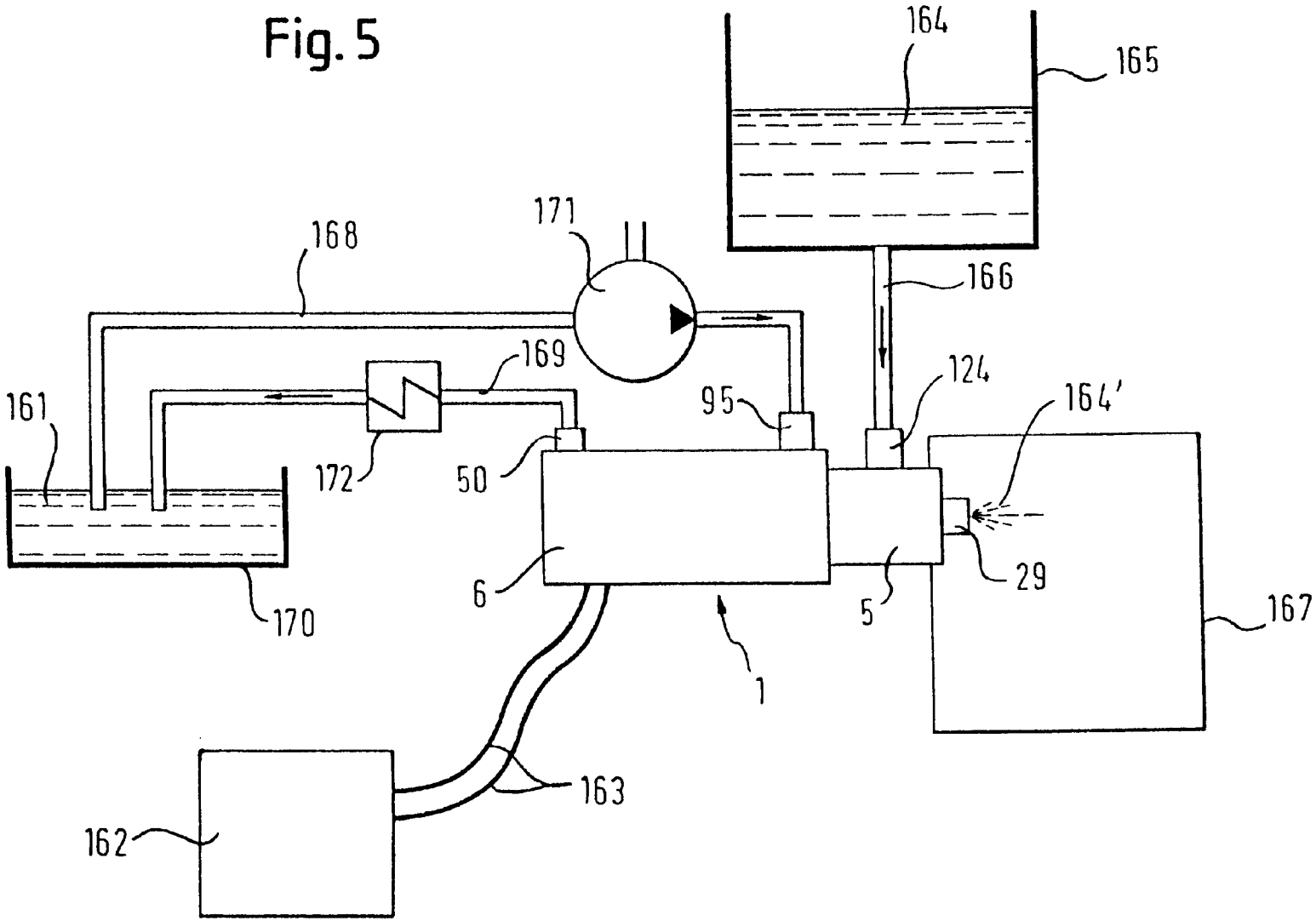
FIG. 5 shows, schematically, the arrangement of a pump arrangement according to FIG. 3 in one case of application.

One case of application of a pump arrangement according to FIG. 3 is illustrated schematically in FIG. 5. On the ejecting side, the arrangement comprising the supply tank 165, which holds the working fluid 164, the supply line 166, which is connected to the feeding device 124, and the pumping device 5, which is connected to the user 167, is identical to the corresponding arrangement according to FIG. 4.

Similarly, as in the case of application according to FIG. 4, the drive unit 6 is supplied with electrical drive power via a control device 162 and electrical supply lines 163. In order to ensure the continuous flushing of the armature space 72 (cf. FIG. 3) and the intermittent flushing of the pressure-accumulating space 4*a* (cf. FIG. 3) the drive unit 6 of the pump arrangement 1 is connected via an admission line 168 and a return line 169 to a supply container 170 in which the operating fluid 161 is located. Installed in the admission line 168 is a circulating pump 171 which is preferably driven electrically and generates sufficient pressure and volumetric flow in the admission line 168 in order for flow to happen along the flow paths I, II (cf. FIG. 3). At high pumping capacities of the pump arrangement 1 it is also advantageous to cool the operating fluid 161. For this purpose, a fluid-cooling device, for example a heat exchanger 172, is provided, for example in the return line 169.

In the following, the pumping method is explained by reference to the functioning of a pump arrangement 1 according to the invention and according to FIG. 1.

In the rest of the description the combination of the pressure-accumulating space 4*a*, through space 66, armature space 72, overflow holes 70, 71, bottom chamber 69, annular gap 68 and central hole 51 of the connecting branch 50 is referred to as the flood space.

If the current conduction through the coil 86 is interrupted, the pump arrangement 1 is located in the starting position in which the armature element 80 is brought by means of the compression spring 82 into the drive-side end position, with the result that the bottom-side end surface 77 of the armature 74 bears against the annular element 83.

The armature-bearing tube 61 is therefore also located in its starting position and is arranged with its ejecting-side end at an axial spacing $s_v$ away from the ball 11.

The ball 11 is brought by the compression spring 9 into its starting position and bears against the ribs 65. In the starting position, the flood space and the pressure-accumulating space 4*a* are filled with the operating fluid 161 in a bubble-free manner and are hydraulically connected via the open ball-valve device 12. On the ejecting side in the starting position, the pressure space 39 is likewise filled with the working fluid 164 in a bubble-free manner, in which case the one-way valve of the feeding device 28 is closed. Furthermore, the threshold-pressure valve of the working-fluid spraying device 29 is closed and seals the pressure space in the ejecting direction.

If the coil 86 is now supplied with current, the armature element 80 is subjected to a magnetic force which accelerates the armature element 80 in a virtually resistant-free manner over the distance $s_v$ against the small pressure of the compression spring 82. In the process, the armature element 80 absorbs kinetic energy and stores it. The liquid volumes of the operating fluid 161, which are located in front of the armature 74 and between the armature-bearing tube 61 and the ball 11 during the acceleration phase and which are displaced by the armature element 80, are able to flow via the grooves 78 and the through space 66 and thus do not form any pressure resistance for the armature element 80. Thus, during the acceleration phase over the distance $s_v$ a constant equalization of pressure and volume between the delivery-side and drive-side region of the flood space takes place. The equalizing container 52 is therefore neither supplied with operating fluid 161 nor is any taken away from it.

If the armature element 80 now strikes with the chamfer 73 against the ball 11, the kinetic energy of the armature element 80 is abruptly transmitted to the ball 11. At the same time, said ball seals the overflow section through the through space 66 via the chamfer 73. A pressure wave is therefore induced in the pressure-accumulating space 4*a*, said pressure wave expanding in the pressure-accumulating space 4*a* at an expanding speed which is characteristic for the operating fluid 161 and striking against the diaphragm 17. The pressure wave striking against the diaphragm 17 is transmitted to the pressure space 39 and therefore the working fluid 164 as a function of the material properties of the diaphragm 17. If the characteristic opening pressure of the threshold-pressure valve in the pressure space 39 is exceeded, the threshold-pressure valve opens and the working fluid 164 is sprayed.

The supply of current is, if appropriate, also still maintained after the generation of the pressure surge, so that the armature element 80 continues to be moved until the desired quantity of working fluid is sprayed. If the supply of current to the coil 86 is interrupted, the compression spring 82 pushes the armature element 80 back into the starting position again. At the same time, the ball 11 is moved into its starting position via the flat coil spring 9. Furthermore, during the return stroke the incompressibility of the operating fluid 161 means that the movement of the ball 11 is transmitted to the diaphragm 17 with a suction effect, as a result of which a negative pressure is generated in the pressure space 39 and if it falls below the characteristic opening pressure of the one-way valve in the feeding device 28 it opens said valve and enables the working fluid 164 to flow again into the pressure space 39.

During the period of time of the mutual forward and backward movement of the armature element 80 and of the ball 11, the pressure in the flood space has to be equalized. During this time segment, operating fluid 161 is first of all removed from the equalizing container 52 (working stroke) and is re-supplied during the return stroke, with the result that an oscillating liquid column is formed in the connecting branch 50 during operation of the pump arrangement 1.

By means of the pumping method according to the invention, it is therefore possible to pump a working fluid 164 which at no time of the operation comes into contact with parts of the drive unit 6. The pumping method according to the invention is therefore also suitable for the metered pumping of strongly corrosive working fluids, in particular of ultrahigh-purity water. For this purpose, only a few parts (delivery housing 25, diaphragm 17, feeding device 28 and working-fluid spraying device 29) have to be adapted in terms of material to the requirements of corrosive working fluids. Depending on the selection of the operating fluid 161 and of the material for the diaphragm 27, the pressure-transmitting parameters (speed of expansion of the pressure surge in the pressure-accumulating space, damping of the pressure surge by the diaphragm) between the pressure-accumulating space 4*a* and pressure space 39 can be set to meet with requirements.

If the working fluid 164 is a fluid which does not corrode the drive parts, it may also be used as the operating fluid 161. Liquids which do not corrode the drive parts are preferably used as the operating fluid 161. Hydrocarbon compounds which preferably also contain lubricating constituents for sliding parts of the drive are particularly suitable for this. Furthermore, the operating fluid and working fluid may be fluids which differ in density. During operation of a pump arrangement 1 according to the invention, it is particularly expedient to cool the operating fluid 161 outside the pump arrangement 1 and to intermittently flush the pressure-accumulating space 4*a* with cooled operating fluid 161 so as to avoid cavitation phenomena. In the event of high loads it is advantageous to continuously flush the armature space 72 with cooled operating fluid 161 so as to ensure adequate removal of waste heat.

A plastic or a metallic material is preferably used as the diaphragm material. In this case, an incompressible or a compressible material (for example, a composite material) may be used.

What is claimed is:

1. A method for metered, pulsed pumping of fluid media under high pressure comprising the steps of:

creating a pressure surge resulting from energy of an electromagnetically driven armature element of a reciprocating pump;

transmitting the energy via a blocking element to a working fluid enclosed in a pressure space connected to a spraying device;

conveying a predetermined quantity of the working fluid out of a spraying unit, wherein the energy of the armature element is created by abruptly transmitting an operating fluid enclosed in a pressure-accumulating space arranged upstream of the pressure space (39), inducing the pressure surge which is transmitted in the operating fluid in an expanding manner to the blocking element and from the blocking element to the working fluid; and wherein different liquids are used as the working fluid and as the operating fluid.

2. The method of claim 1, wherein after the predetermined quantity of working fluid has been injected, working fluid is drawn into the pressure space.

3. The method of claim 1 further comprising cooling the operating fluid and wherein the working fluid is cooled.

4. The method of claim 3 further comprising cooling at least the pressure-accumulating space by flushing with low-temperature operating fluid.

5. The method of claim 1, wherein the operating fluid is displaced during defined pumping phases into an equalizing vessel which communicates with the reciprocating pump and contains operating fluid.

6. The method of claim 1 further comprising utilizing materials which are resistant to the working fluid for those interior surfaces of the pressure space that come into contact with the working fluid.

7. The method of claim 6, wherein the operating fluid comprises hydrocarbon compounds containing lubricating constituents.

8. The method of claim 1, wherein identical liquids are used as the working fluid and as the operating fluid but one is isolated from the other.

9. The method of claim 1 further comprising utilizing a diaphragm as the blocking element.

10. The method of claim 9, wherein the diaphragm is made of one of a plastic material, a metallic material, an incompressible material, and a compressible material.

11. The method of claim 9 further comprising separating the pressure space and the pressure-accumulating space from each other in a fluid-proof manner.

12. The method of claim 1 further comprising flushing the pressure-accumulating space at least intermittently with operating fluid so as to avoid cavitation phenomena.

13. The method of claim 1, wherein, when a characteristic threshold pressure in the pressure space is exceeded, a threshold-pressure valve, which is integrated in the working-fluid spraying device, opens and the working fluid is thus injected.

14. The method of claim 1, wherein the armature element is accelerated virtually without any resistance over a distance $s_v$.

15. A pump arrangement comprising at least one armature element arranged to absorb and store kinetic energy during an acceleration phase; an ejecting device forming a pressure space for a working fluid to be pumped and having a feeding device, a working-fluid spraying device and a blocking element therein, the blocking element covering the pressure space on one side and being subjected to the kinetic energy of the armature element; wherein the kinetic energy is converted by a surge movement into a pressure surge, and said kinetic energy conveying the pressure surge to the working fluid, wherein a pressure-accumulating-space cylinder, is arranged upstream of the blocking element and the armature element in such a manner to transmit the stored, kinetic energy in a surge-like manner to operating fluid transferred therethrough;

wherein the ejecting device is arranged upstream of the pressure-accumulating-space cylinder in an axial manner on a delivery side and an electromagnetic drive unit is arranged downstream on a drive side; and wherein a through hole is designed having two constrictions in an end region on a delivery side, thereby forming a first annular step and a second annular step, on which a compression spring is supported, which compression spring extends into a region of the through hole which is on a drive side and stresses a ball which fills a drive-side opening of the through hole and is part of a ball-valve device.

16. A pump arrangement comprising at least one armature element arranged to absorb and store kinetic energy during an acceleration phase; an ejecting device forming a pressure space for a working fluid to be pumped and having a feeding device, a working-fluid spraying device and a blocking element therein, the blocking element covering the pressure space on one side and being subjected to the kinetic energy of the armature element; wherein the kinetic energy is converted by a surge movement into a pressure surge, and said kinetic energy conveying the pressure surge to the working fluid, wherein a pressure-accumulating-space cylinder, is arranged upstream of the blocking element and the armature element in such a manner to transmit the stored, kinetic energy in a surge-like manner to operating fluid transferred therethrough;

wherein the ejecting device is arranged upstream of the pressure-accumulating-space cylinder in an axial manner on a delivery side and an electromagnetic drive unit is arranged downstream on a drive side; and wherein a drive-side end surface of the pressure-accumulating-space cylinder is planar and an ejecting-side end surface of the pressure-accumulating-space cylinder is depressed in a direction of the drive side, and is recessed in a concavely curved manner in cross section and has an annular bearing surface on the periphery, the recess forming a cavity which is covered by the blocking element which is designed as a diaphragm and bears against the bearing surface.

17. The pump arrangement of claim 16, wherein the bearing surface for the diaphragm is fixed to an annular web which is arranged on the diaphragm side of the pressure-accumulating space cylinder.

18. The pump arrangement of claim 17, wherein the pressure-accumulating-space cylinder is fitted, butting against a stop element, by its drive-side region in a form-fitting manner into a connecting cylinder having an external thread and from the ejecting side or delivery side is overlapped in a screwed manner by a cylinder region of the ejecting device, which region has a corresponding internal thread and wherein in the cylinder region an annular step lying opposite the bearing surface is provided and the diaphragm is clamped in place by the bearing surface and the annular step.

19. A pump arrangement comprising at least one armature element arranged to absorb and store kinetic energy during an acceleration phase; an ejecting device forming a pressure space for a working fluid to be pumped and having a feeding device, a working-fluid spraying device and a blocking element therein, the blocking element covering the pressure space on one side and being subjected to the kinetic energy of the armature element; wherein the kinetic energy is converted by a surge movement into a pressure surge, and said kinetic energy conveying the pressure surge to the working fluid, wherein a pressure-accumulating-space cylinder, is arranged upstream of the blocking element and the armature element in such a manner to transmit the stored, kinetic energy in a surge-like manner to operating fluid transferred therethrough;

wherein the ejecting device is arranged upstream of the pressure-accumulating-space cylinder in an axial manner on a delivery side and an electromagnetic drive unit is arranged downstream on a drive side; and wherein a pressure-accumulating space essentially comprising a through hole and a cavity is formed between a ball of a ball-valve device and the blocking element.

20. The pump arrangement of claim 19, wherein the blocking element is designed as a diaphragm and the pressure space is partitioned off from the pressure-accumulating space by the diaphragm in a fluid-proof manner.

21. The pump arrangement of claim 19, wherein the pressure-accumulating-space cylinder is designed as a valve support which has a nipple-shaped feeding device together with a nonreturn valve.

22. The pump arrangement of claim 21, wherein the pressure-accumulating space is connected via a flood hole and the nonreturn valve to the feeding device.

23. The pump arrangement claim of 19, wherein the ejecting device has a delivery housing having a working-fluid spraying device arranged at one end, and a feeding device connected at a pressure-chamber hole and an admission hole.

24. The pump arrangement of claim 23, wherein the feeding device contains a one-way valve which enables the working fluid to flow into the pressure space and stops the working fluid from flowing out of the pressure space.

25. The pump arrangement of claim 23, further comprising a static-pressure valve arranged hydraulically directly upstream of the working-fluid spraying device and in the region of the pressure-chamber hole.

26. The pump arrangement of claim 23, wherein the working-fluid spraying device has a threshold-pressure valve arranged in a pressure space so that when a characteristic threshold pressure in the pressure space is exceeded, the working fluid is injected.

27. The pump arrangement of claim 19, used to deliver small quantities of fluid at high pressure in a metered manner.

28. A pump configured to deliver quantities of a liquid under high pressure, the pump comprising:

a guide cylinder having an armature assembly operable therein;

a pressure-accumulating-space cylinder in fluid communication with the guide cylinder and arranged to have a first fluid therein;

an ejecting device having a fluid inlet, a fluid outlet, and a pressure space therein to transfer a second fluid therethrough and arranged in fluid isolation from the pressure-accumulating-space cylinder; and a blocking element located between the pressure-accumulating-space cylinder and the ejecting device to fluidly isolate the guide cylinder and pressure-accumulating-space from the ejecting device.

29. The pump of claim 28 wherein the blocking element is a diaphragm and wherein the first fluid is an operating fluid and the second fluid is a working fluid.

30. The pump of claim 29 wherein the working fluid and the operating fluid are different fluids.

31. The pump of claim 29 wherein the diaphragm is constructed of one of a plastic material, a metallic material, an incompressible material, and a compressible material.

32. The pump of claim 28 wherein the blocking element transmits a pressure surge formed by movement of the armature assembly in the guide cylinder on the first fluid to the second fluid, which is caused to be ejected from the ejecting device.

33. The pump of claim 32 wherein after a predetermined quantity of second fluid is ejected, a quantity of second fluid is drawn into the pressure space through the fluid inlet of the ejecting device.

34. The pump of claim 28 wherein the pressure-accumulating-space cylinder has a slipped, through hole which is arranged around a central axis.

35. The pump of claim 34 wherein the through hole forms a first annular step and a second annular step.

36. The pump of claim 35 wherein a compression spring is supported on the second annular step and extends into the through hole to engage a ball of a ball-valve device and a pressure-accumulating space is formed between the ball of the ball-valve device and the blocking element.

37. The pump of claim 28 wherein the first fluid includes hydrocarbon compounds for lubrication.

38. The pump of claim 28 wherein the first and second fluids are the same fluid.

39. The pump of claim 28 further comprising a fluid feeding device in fluid communication with the pressure-accumulating-space cylinder to intermittently replace the first fluid.

40. The pump of claim 28 further comprising a threshold-pressure valve in fluid communication with a pressure space defined in the ejecting device wherein the threshold-pressure valve is opened to release the first fluid from the pressure space when a characteristic threshold pressure in the pressure space is exceeded.

41. The pump of claim 28 wherein a drive-side end surface of the pressure-accumulating-space cylinder is planar and an ejecting-side end surface of the pressure-accumulating-space cylinder is depressed in the direction of a drive side.

42. The pump of claim 41 wherein the drive side has a recess that is concave and wherein the recess is covered by the blocking element.

43. The pump of claim 42 wherein the drive side has an annular bearing surface on a periphery and wherein the annular bearing surface is fixed to an annular web arranged on the pressure-accumulating-space cylinder.

44. The pump of claim 28 wherein the pressure-accumulating-space cylinder further comprises a valve support comprising a feeding device and a non-return valve.

45. The pump of claim 28 wherein the ejecting device comprises a delivery housing, a spraying device, and a feeding device, and wherein the delivery housing, the spraying device, and the feeding device are connected to one another via a pressure-space hole and an admission hole.

46. The pump of claim 28 wherein a hydraulic, static-pressure valve is arranged upstream of the ejecting device.

47. The pump of claim 28 wherein the armature assembly comprises a hollow-cylindrical coil module having at least one coil, an armature cylinder and an armature element having an armature-bearing tube and an armature therein, and wherein the hollow-cylindrical coil, the armature cylinder and the armature element are radially aligned within the pump housing.

48. The pump of claim 28 wherein the pressure-accumulating space cylinder is arranged to allow continuous fluid flow therethrough.

49. The pump of claim 28 configured to deliver small quantities of atomized fluid at high pressure in a metered manner.

50. A reciprocating pump comprising:

a guide cylinder;

at least one armature element disposed within the guide cylinder and configured to transfer energy during actuation;

an ejection device having a fluid inlet and a fluid outlet;

a pressure-accumulating-space cylinder abutting the guide cylinder and having therein a pressure-accumulating space;

a blocking element disposed between the pressure-accumulating space and the ejecting device and configured to receive energy from the at least one armature element;

wherein the ejection device further comprises:

a pressure space constructed to receive and transfer a working fluid disposed within the pressure space and is situated to receive a pressure surge from the blocking element; and a working-fluid spraying device in fluid communication with the pressure space and configured to spray a predetermined quantity of working fluid upon receipt of such a pressure surge.

51. The reciprocating pump of claim 50 wherein the blocking element is a diaphragm and provides a fluid barrier between the pressure space designed for transfer of a working fluid and the pressure-accumulating space designed for operation with an operating fluid.

52. The reciprocating pump of claim 50 wherein the pressure-accumulating space is formed of a stepped, through hole within the pressure-accumulating-space cylinder and forms a first annular step and a second annular step.

53. The reciprocating pump of claim 52 further comprising a ball-valve device restricting operating fluid to flow in one direction and wherein a compression spring engages the second annular step and extends through the through hole to engage a ball of the ball-valve device positioned in close proximity to the through hole.

54. The reciprocating pump of claim 52 wherein the blocking element is secured between a bearing surface and the first annular step and the second annular step.

55. The reciprocating pump of claim 54 wherein the bearing surface is fixed to an annular web.

56. A method of metered pumping of a fluid media comprising:

transmitting energy in a driven armature element of a reciprocating pump to an operating fluid enclosed in a pressure-accumulating space;

transferring the energy from the operating fluid to a blocking element in the form of a pressure surge; and transmitting the pressure surge from the blocking element to a working fluid enclosed in a pressure space, fluidly isolated from the operating fluid, wherein a predetermined quantity of the working fluid is ejected from the pressure space.

57. The method of claim 56 further comprising providing a blocking element that is impermeable by the operating fluid and the working fluid.

58. The method of claim 56 further comprising drawing a quantity of working fluid into the pressure space after the predetermined quantity of working fluid is ejected.

59. The method of claim further comprising cooling the operating fluid at least periodically.

60. The method of claim 56 further comprising at least intermittently flushing the pressure-accumulating space with operating fluid.

61. The method of claim 56 further comprising displacing the operating fluid to an equalizing vessel which is in fluid communication with the reciprocating pump.

62. The method of claim 56 further comprising opening a threshold-pressure valve if a threshold pressure is exceeded within the pressure space and allowing working fluid to eject through the threshold-pressure valve if a threshold pressure is exceeded within the pressure space.

63. The method of claim 56 further comprising accelerating the armature element over a predetermined distance to transmit the energy to the operating fluid.

64. The method of claim 63 wherein the accelerating is achieved with minimal resistance.

* * * * *

UNITED STATES PATENT AND TRADEMARK OFFICE

CERTIFICATE OF CORRECTION

PATENT NO. : 6,607,361 B1
DATED : August 19, 2003
INVENTOR(S) : Kotter et al.

It is certified that error appears in the above-identified patent and that said Letters Patent is hereby corrected as shown below:

Column 6,
Line 15, delete the word "a" before the word "and";

Column 7,
Line 42, delete "24" and substitute therefore -- 124 --;

Column 14,
Line 2, delete "slipped" and substitute therefor -- stepped --.

Signed and Sealed this

Second Day of December, 2003

JAMES E. ROGAN
*Director of the United States Patent and Trademark Office*